US007082745B2

(12) United States Patent
Takahashi

(10) Patent No.: US 7,082,745 B2
(45) Date of Patent: Aug. 1, 2006

(54) CLUMP CUTTER APPARATUS OF ELASTIC YARN

(75) Inventor: Tomoaki Takahashi, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 11/125,249

(22) Filed: May 10, 2005

(65) Prior Publication Data

US 2005/0284981 A1 Dec. 29, 2005

(30) Foreign Application Priority Data

Jun. 23, 2004 (JP) ..... 2004-184548

(51) Int. Cl.
*B65H 69/06* (2006.01)

(52) U.S. Cl. ..... 57/22; 57/202

(58) Field of Classification Search ..... 57/22, 57/23, 202

See application file for complete search history.

(56) References Cited

U.S. PATENT DOCUMENTS 3,570,339 A * 3/1971 Vandersip ..... 83/24
4,170,103 A * 10/1979 Norris et al. ..... 57/293
4,893,461 A * 1/1990 Artzt et al. ..... 57/261
2002/0174643 A1 * 11/2002 Humml ..... 57/22

FOREIGN PATENT DOCUMENTS

JP 2002-363834 12/2002

* cited by examiner

*Primary Examiner*—Shaun R Hurley
(74) *Attorney, Agent, or Firm*—Westerman, Hattori, Daniels & Adrian, LLP.

(57) ABSTRACT

To provide a clump cutter apparatus of an elastic yarn for improving a success ratio of clump cutting when cutting the elastic yarn running in a draft state. A clump cutter apparatus of an elastic yarn configured by overlapping and combining a plurality of laminate layer blocks 2 forming a penetrating yarn running path RP for allowing running of a yarn to a direction of a yarn running, wherein the plural laminate layer blocks include first and second slide blocks 4 and 5; and the clump cutter apparatus comprising: yarn holding means 12 for holding the yarn in the yarn running path due to movement of the first slide block and yarn cutting means 13 for cutting the yarn due to movement of the second slide block after holding the yarn by the yarn holding means.

7 Claims, 5 Drawing Sheets

CLUMP CUTTER APPARATUS OF ELASTIC YARN

BACKGROUND OF THE INVENTION

1. Technical Field

The present invention relates to a clump cutter apparatus for cutting a yarn as holding it when cutting of the yarn is required in a handling step of a yarn in a textile machine, and particularly, the present invention relates to a clump cutter apparatus of an elastic yarn for improving a success ratio of clump cutting when cutting the elastic yarn running in a draft state.

2. Related Background Art

As well known, when cutting of a yarn at a yarn supply source is required in textile machine such as a draw-twister, a doubler-twister, a spinning machine, or a winder or the like, for example, in a draw-twister, a method for cutting the running yarn and holding a yarn end of a yarn supplying side of the cut yarn when the yarn is winded around a draft roller and the yarn is cut at a supply source of a no-draft yarn has been known.

Conventionally, in the textile machine, as an apparatus for cutting the yarn as holding it, a clump cutter apparatus as disclosed in JP-A-2002-363834 (Abstract, FIG. 4, FIG. 11) has been used. The clump cutter apparatus shown in this JP-A-2002-363834 (Abstract, FIG. 4, FIG. 11) is a structure represented by a reference numeral 33 in FIG. 4 and FIG. 11 and this clump cutter apparatus is provided with one slide block that is operated by an actuator 54 as one driving source. The detail of this is indicated in JP-B-48-8776 (FIG. 1, FIG. 2, FIG. 3) and it will be described on the basis of the drawings (FIG. 3C1, FIG. 3C2) attached to the present specification. As shown in FIG. 3C1 and FIG. 3C2, a conventional clamp cutter apparatus is configured by a slide block 43 sliding in one direction by one driving source between a fixed block 41 at the upper side and a cutter 42 at the lower side, in which a fixed block, a slide block, and a cutter are laminated in this order. In this case, through holes 44, 45, and 46 are provided in the fixed block 41 at the upper side, the slide block 43, and the cutter 42 at the lower side, respectively, and in the lamination, a penetrating yarn running path RP for allowing running of a yarn Y is configured.

However, this conventional clamp cutter apparatus is only provided with one slide block 43 sliding in one direction by one driving source between a fixed block 41 at the upper side and a cutter 42 at the lower side. Therefore, the yarn Y is cut almost at the same time as holding the yarn Y when the slide block 43 slides, so that this involves a problem such that a success ration of clump cutting is low and the cut yarn end is frequently released.

SUMMARY OF THE INVENTION

The present invention has been made taking the foregoing problems into consideration and an object of which is to provide a clump cutter apparatus for cutting a yarn as holding it when cutting of the yarn is required in a handling step of a yarn in a textile machine, and particularly, to provide a clump cutter apparatus of an elastic yarn for improving a success ratio of clump cutting when cutting the elastic yarn running in a draft state.

In order to achieve the above-described object, specifically, the present invention provides a clump cutter apparatus of an elastic yarn configured by overlapping and combining a plurality of laminate layer blocks forming a penetrating yarn running path for allowing running of a yarn to a direction of a yarn running, wherein the plural laminate layer blocks include first and second slide blocks; and the clump cutter apparatus comprising: yarn holding means for holding the yarn in the yarn running path due to movement of the first slide block and yarn cutting means for cutting the yarn due to movement of the second slide block after holding the yarn by the yarn holding means.

Further, according to the present invention, the invention described in claim 2 may comprise the clump cutter apparatus of an elastic yarn according to claim 1, wherein the yarn holding means includes the first slide block, a laminate layer block face-to-face contacting the upstream side of the first slide block, and the second slide block face-to-face contacting the downstream side of the first slide block; and the yarn cutting means include the second slide block and a cutter blade member face-to-face contacting the downstream side of the second slide block.

Still further, according to the present invention, the invention described in claim 3 may comprise the clump cutter apparatus of an elastic yarn according to claim 1 or 2, wherein a width of the upstream side path of the yarn running path in the second slide block is made narrower than that of the downstream side path thereof.

Still further, according to the present invention, the invention described in claim 4 may comprise the clump cutter apparatus of an elastic yarn according to any one of claim 1 to 3, having first driving means for reciprocating the first slide block toward a first direction and second driving means capable of reciprocating the second slide block toward a second direction opposed to the first direction in the order of moving the second slide block after moving the first slide block.

BRIEF DESCRIPTION OF THE DRAWINGS

FIG. 1A is a schematic sectional side view showing a state that the elastic yarn is located in a yarn running path in the apparatus; FIG. 1B is a schematic sectional side view showing a state that a first slide block configuring a yarn holding means moves slidably so as to hold the elastic yarn; and FIG. 1C is a schematic sectional side view showing a state that a second slide block configuring a yarn cutting means moves slidably so as to cut the elastic yarn.

DESCRIPTION OF THE PREFERRED EMBODIMENTS

Figure 1:
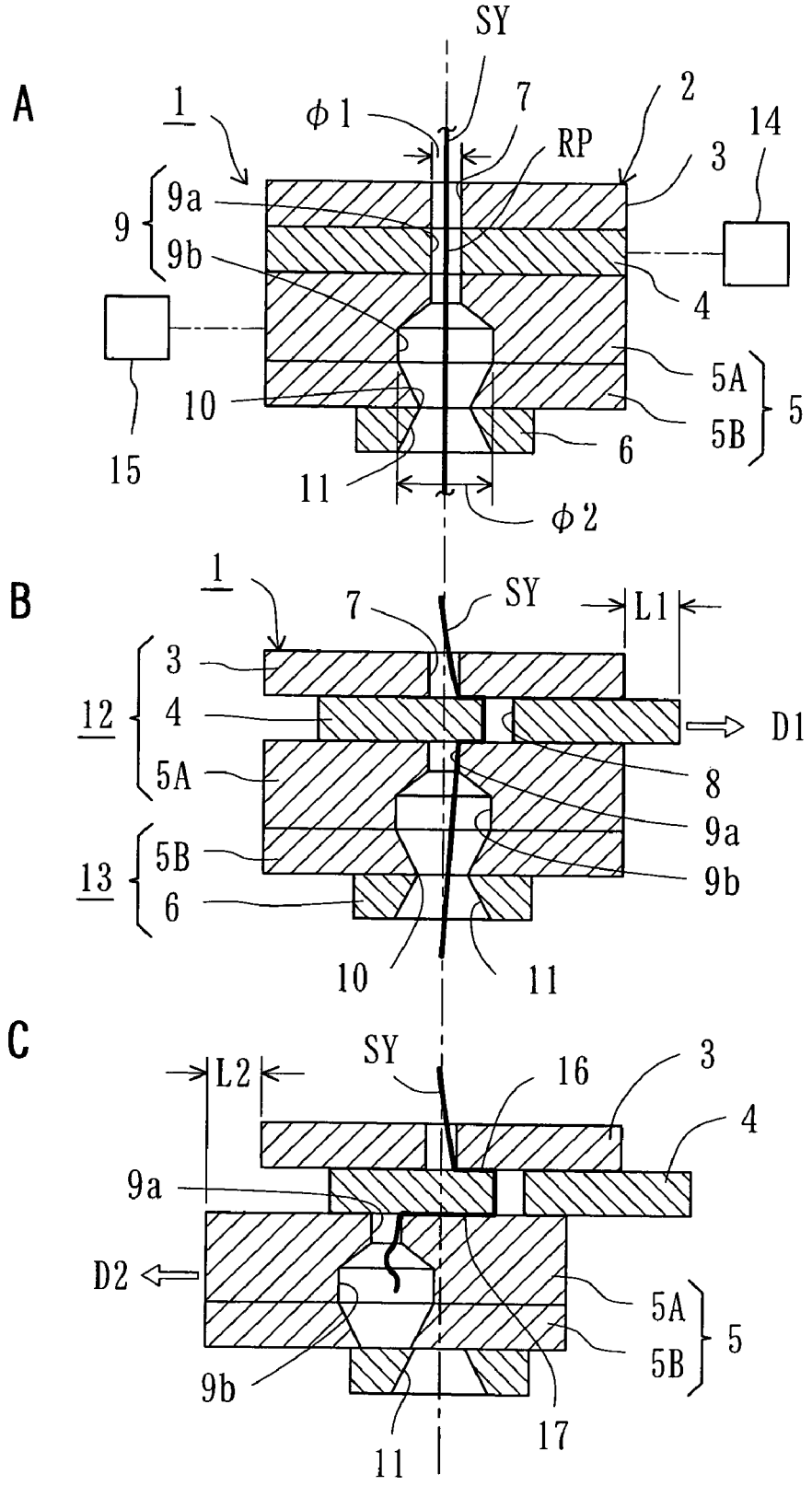
FIG. 1 is an explanatory view showing a basic structure of a clump cutter apparatus of an elastic yarn according to the present invention together with its operation pattern; specifically.

With reference to the specific embodiments shown in the drawings, the clump cutter apparatus of the elastic yarn of the present invention will be described below.

A clump cutter apparatus 1 of an elastic yarn according to the present invention is basically configured by a combination of a plurality of laminate layer blocks 2 forming a penetrating yarn running path RP for allowing pass of an elastic yarn SY with a direction overlapping a plate thickness adjusted to a direction of a yarn running, and these laminate layer blocks 2 are configured by a fixed block 3 at the upper side, a first slide block 4, a second slide block 5, and a fixed block 6 at the lower side as a cutter blade. The fixed block 3 at the upper side is provided with a relatively small through hole 7 with a diameter ϕ 1, the first slide block 4 is provided with a relatively small through hole 8 of a diameter ϕ 1, the second slide block 5 is provided with a through hole 9 made of a part 9*a* of a relatively small diameter ϕ 1 at the upstream side and a part 9*b* of a relatively large diameter ϕ 2 at the downstream side, and the fixed block 6 at the downstream side is provided with a through hole 11 configuring a cutter blade 10. The yarn running path RP is configured by each through hole provided to each block. According to the preferable embodiments, the second slide block 5 is configured by a combination of an upper side member 5A and a lower side member 5B.

According to the present invention, the first slide block 4 and the second slide block 5 are configured so that they move slidably into directions opposed each other. The fixed block 3 at the upper side, the first slide block 4, and an upper side member 5A of the second slide block 5 configure yarn holding means 12, and a lower side member 5B of the second slide block 5 and the fixed block 6 at the lower side configure yarn cutting means 13.

According to the embodiment shown in FIG. 1, for example, the first slide block 4 is configured to slidably move toward a first direction D1 at a distance L1 by first driving means 14 made of an actuator, and the second slide block 5 is configured to slidably move toward a second direction D2 at a distance L2 by second driving means 15.

In the clump cutter apparatus 1 of the elastic yarn configured as described above, the operational procedure to hold and cut the elastic yarn SY is shown in FIG. 1A, FIG. 1B, and FIG. 1C. At first, as shown in FIG. 1A, by operating the first driving means 14 as shown in FIG. 1B from the state that the elastic yarn SY is inserted through the yarn running path RP as shown in FIG. 1A, the first slide block 4 slidably moves toward the first direction D1 at a distance L1. Due to this slidable movement of the first slide block 4, the elastic yarn SY is held by a first holding part 16 between the downstream side of the fixed block 3 at the upper side and the upstream side of the first slide block 4 and a second holding part 17 between the downstream side of the first slide block 4 and the upstream side of the upper side member 5A in the second slide block 5.

Operating this first driving means 14 to hold the elastic yarn SY, and then, operating the second driving means 15 as shown in FIG. 1C, the second slide block 5 slidably moves toward the second direction D2 at a distance L2. Due to this slidable movement of the second slide block 5, the elastic yarn SY is reliably held between the downstream side of the first slide block 4 and the upper side member 5A in the second slide block 5 at a longer distance, and the elastic yarn SY is cut by the operation of the cutter blade 10 due to sliding between the downstream side of the lower side member 5B in the second slide block 5 and the upstream side of the fixed block 6 at the lower side.

Each of FIG. 3B is a schematic sectional side view showing other embodiment of the clump cutter apparatus 1 of the elastic yarn according to the present invention together with its operating pattern. A clump cutter apparatus 1 according to the present embodiment is basically configured by a combination of a plurality of laminate layer blocks 2 forming a penetrating yarn running path RP for allowing pass of an elastic yarn SY with a direction overlapping a plate thickness adjusted to a direction of a yarn running, and these laminate layer blocks 2 are configured by a fixed block 3 at the upper side, a first slide block 4, a second slide block 5, and a fixed block 6 at the lower side as a cutter blade. The fixed block 3 at the upper side is provided with a relatively small through hole 7 with a diameter ϕ 1, the first slide block 4 is provided with a through hole 8 made of a part 8*a* of a relatively small diameter ϕ 1 at the upstream side and a part 8*b* of a relatively large diameter ϕ 2 at the downstream side, the second slide block 5 is provided with a through hole 9, and the fixed block 6 at the downstream side is provided with a through hole 11 configuring a cutter blade 10. The yarn running path RP is configured by each through hole provided to each block.

According to the present invention, the first slide block 4 and the second slide block 5 are configured so that they move slidably into directions opposed each other. The fixed block 3 at the upper side, the first slide block 4, and the second slide block 5 configure yarn holding means 12, and the second slide block 5 and the fixed block 6 at the lower side configure yarn cutting means 13.

According to the present embodiment, for example, the first slide block 4 is configured to slidably move toward a first direction by first driving means made of an actuator, and the second slide block 5 is configured to slidably move toward a second direction by second driving means.

Figure 2:
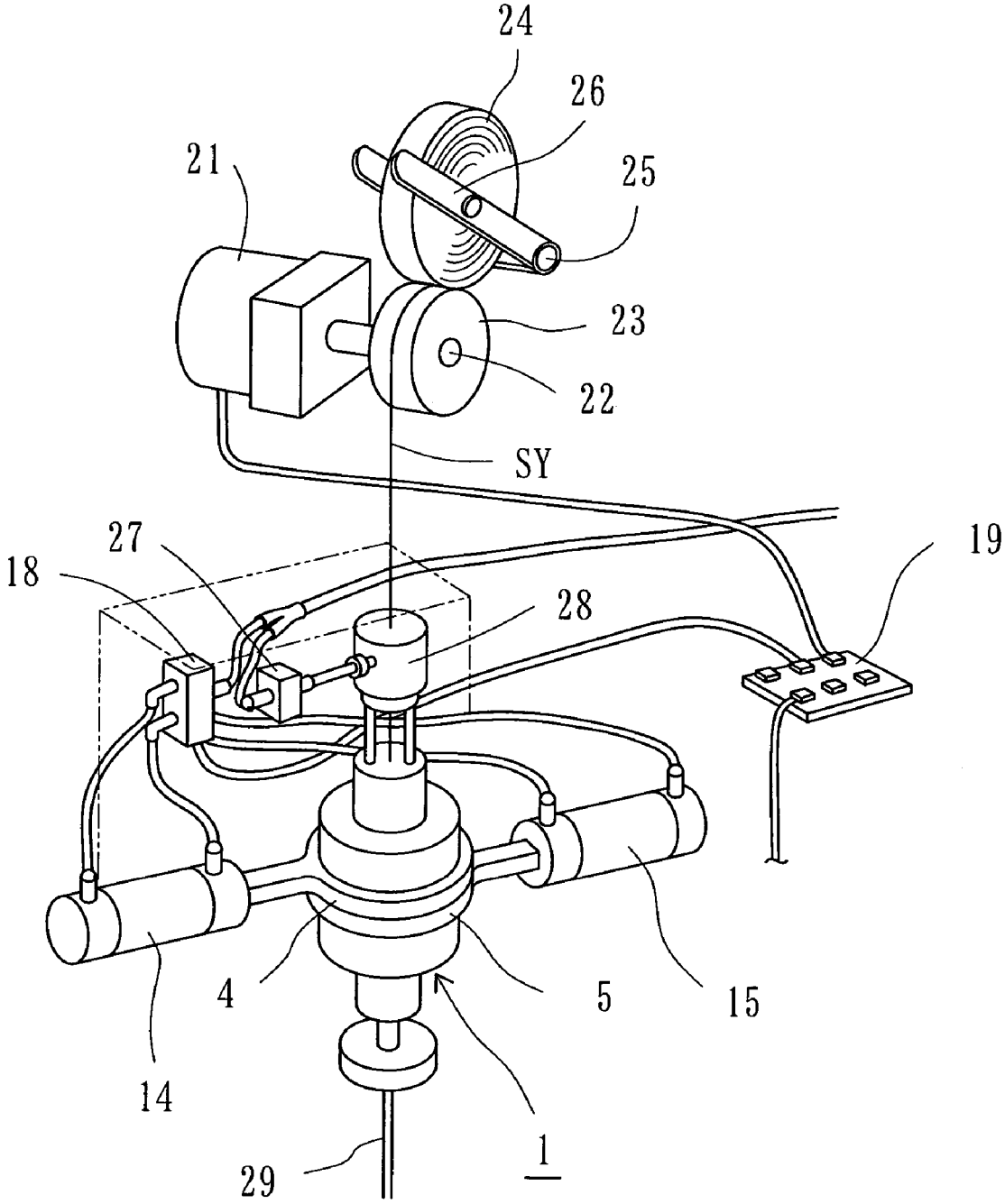
FIG. 2 is an external view showing an example of applying the clump cutter apparatus according to the present invention and a perspective view showing details of a control system.

In the clump cutter apparatus 1 of the elastic yarn configured as described above, according to the operational procedure to hold and cut the elastic yarn SY, at first, by operating the first driving means as shown in FIG. 3B2 from the state that the elastic yarn SY is inserted through the yarn running path RP as shown in FIG. 3B1, the first slide block 4 slidably moves toward the first direction. Due to this slidable movement of the first slide block 4, the elastic yarn SY is held by a first holding part 16 between the downstream side of the fixed block 3 at the upper side and the upstream side of the first slide block 4 and a second holding part 17 between the downstream side of the first slide block 4 and the upstream side of the second slide block 5.

Figure 3:
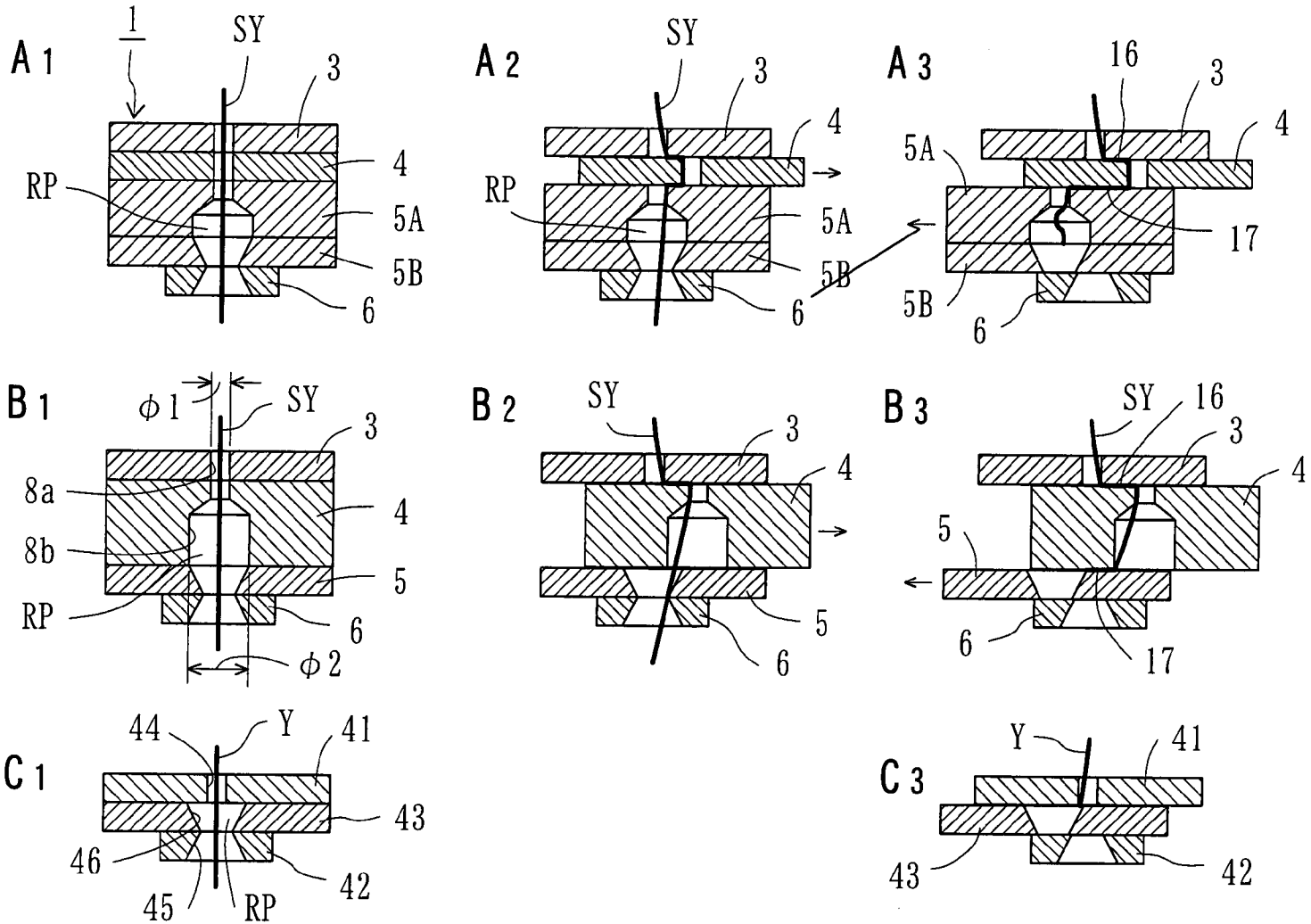
FIG. 3 is an explanatory view showing a specific structure of the clump cutter apparatus according to the present invention as compared to a conventional one; specifically, each of FIG. 3A is a schematic sectional side view showing the most preferable embodiment of the present invention together with its operating pattern; each of FIG. 3B is a schematic sectional side view showing other embodiment of the present invention together with its operating pattern; and each of FIG. 3C is a schematic sectional side view showing a clump cutter apparatus according to a conventional example together with its operating pattern.

Operating this first driving means to hold the elastic yarn SY, and then, operating the second driving means as shown in FIG. 3B3, the second slide block 5 slidably moves toward the second direction. Due to this slidable movement of the second slide block 5, the elastic yarn SY is reliably held between the downstream side of the first slide block 4 and the upstream side of the second slide block 5, and the elastic yarn SY is cut by the operation of the cutter blade 10 due to sliding between the downstream side of the second slide block 5 and the upstream side of the fixed block 6 at the lower side.

According to the embodiment shown in FIG. 3B, when the second slide block 5 slidably moves, the yarn is cut. In this case, even if the yarn end is not held between the first slide block 4 and the second slide block 5, as compared to the conventional one, the success ratio of the clump cutting is improved. However, as the above-described embodiment, when the yarn is held by a plurality of holding parts, namely, the first holding part 16 and the second holding part 17, the success ratio of the clump cutting can be more improved.

In addition, according to the embodiments shown in FIG. 1 and FIG. 3A, since the part 9*a* of a relatively small diameter ϕ 1 at the upstream side and the part 9*b* of a relatively large diameter ϕ 2 at the downstream side are formed on the second slide block 5, when slidably moving the first slide block 4, as shown in FIG. 3A2, wobble of the elastic yarn SY is controlled by the part 9*a* of a relatively small diameter ϕ 1. Thereby, when slidably moving the first slide block 4, the yarn is held by the first holding part 16 and the second holding part 17, at the same time as holding, the elastic yarn SY approaches a through hole 11 and a cutter blade 10, and at the same time as holding or before this, the elastic yarn SY is cut without intension. Thus, it is possible to prevent the yarn from freeing due to contraction. According to such a structure, for example, when the elastic yarn of a light denier, namely, about 20 denier is used as the elastic yarn SY while running it in an extended state, it is feared that the elastic yarn SY approaches the cutter blade 10 and the through hole 11 of the fixed block at the downstream side and the elastic yarn SY is easily cut only touched. Therefore, in such a case, it is preferable that the structure according to the present embodiment is applied.

In addition, since the above-described part 9*a* of a relatively small diameter ϕ 1 is formed, a distance between the through hole 8 of the first slide block 4 after sliding and the part 9*a* of the diameter ϕ 1 is made longer to make a distance to hold the elastic yarn SY longer.

Subsequently, the specific application examples of the clump cutter apparatus 1 of the elastic yarn according to the present invention will be described on the basis of FIG. 2, FIG. 4, and FIG. 5. FIG. 2 is an external view showing an example of applying the clump cutter apparatus according to the present invention and a perspective view showing details of a control system, FIG. 4 is a side view showing structures of a spinning part and a suction nozzle of a textile spinning apparatus and a structure of a yarn relay carriage; and FIG. 5 is a front view showing the textile spinning apparatus and the yarn relay carriage.

Figure 5:
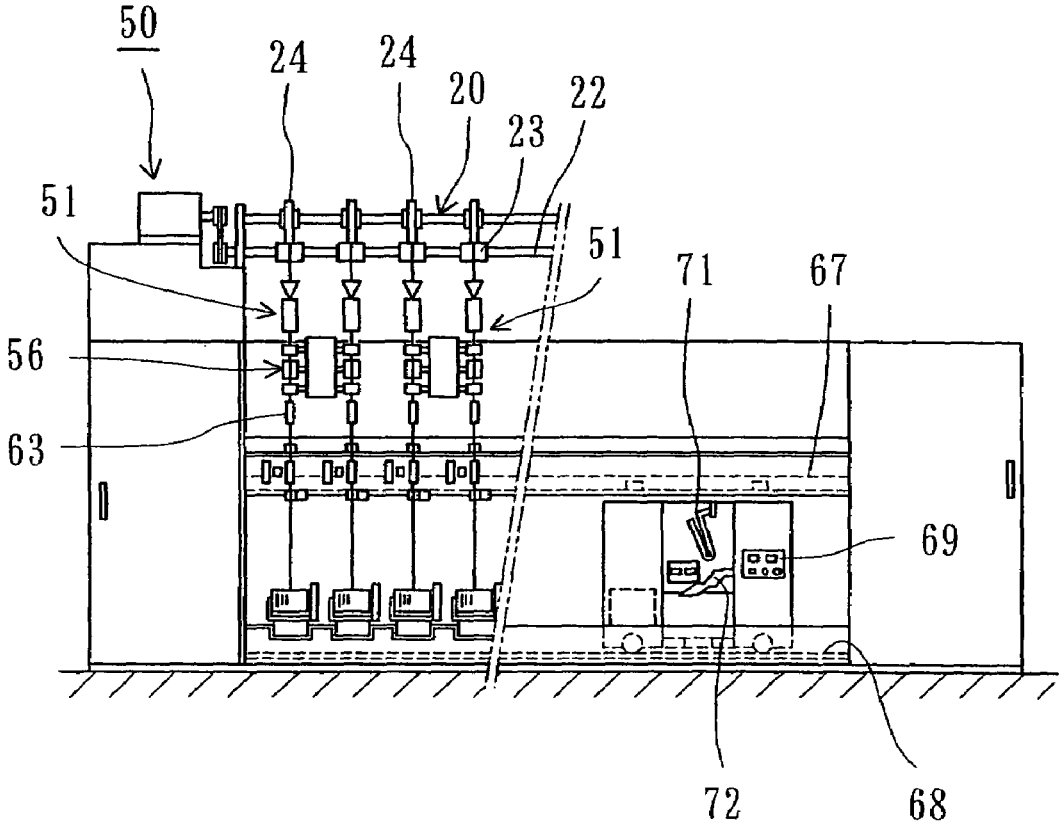
FIG. 5 is a front view showing the textile spinning apparatus and the yarn relay carriage.

The clump cutter apparatus 1 of the elastic yarn according to the present invention is effectively applied to a textile spinning machine 50 as shown in FIG. 5. The textile spinning machine 50 as shown in FIG. 5 is configured with many textile spinning units 51 arranged in a longitudinal direction. On the upper part of each unit 51, a draft apparatus 56 is mounted. The draft apparatus 56 is supplied from a case at a rear part via a guide, for example, drafting a sliver 54 as a covering in a core yarn, the sliver 54 is pulled to a predetermined fiber bundle 55.

Figure 4:
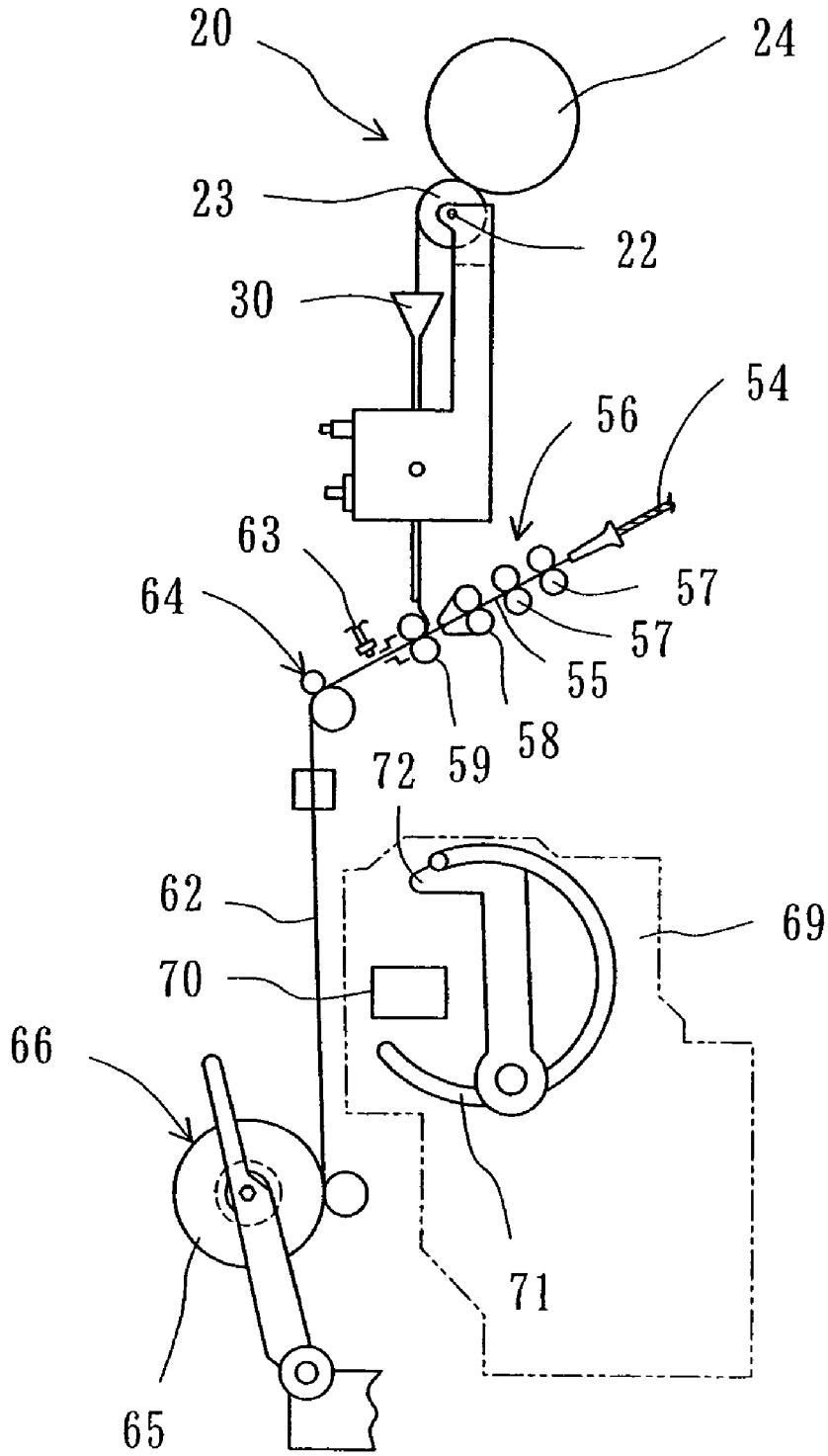
FIG. 4 is a side view showing structures of a spinning part and a suction nozzle of a textile spinning apparatus and a structure of a yarn relay carriage.

As shown in FIG. 4, the draft apparatus 56 is mainly configured by a back roller 57, a middle roller 58 that is winded around an apron, and a front roller 59. At the downstream side of this draft apparatus 56, an air-jet spinning part 63 is arranged in the vicinity of the front roller 59. Each spinning unit 51 is provided with an elastic yarn supplier 20 for supplying the elastic yarn SY having large elasticity to the fiber bundle 55 (the sliver 54) within the draft apparatus 56. The air-jet spinning part 63 may spin a yarn by acting whirl air current of compressed air from an air spinning nozzle to the fiber bundle 55 that is drafted by the draft apparatus 56 and serves to manufacture a core yarn 62 made of covering the outside of the elastic yarn SY as a core fabric with a fabric of the fabric batch 55.

In the above-described apparatus, at the downstream of the air-jet spinning part 63, a yarn feeding roller 64 is provided, which gives a feeding force to the manufactured core yarn 62 and feeds the core yarn 62 to the downstream side. This yarn feeding roller 64 is configured by a pair of a delivery roller at the lower side always rotating and a nip roller at the upper side contacting the delivery roller and driven to rotate and by holding the yarn between the rotating both rollers, the yarn is given the feeding power. At the front lower part of the spinning unit 51, a winding apparatus 66 for winding the core yarn 62 to be fed from the yarn feeding roller 64 around a package 65 is provided.

A frame of the spinning unit 51 is formed with a section C of which front face is open, rails 67 and 68 are mounted in an inner space continued in a longitudinal direction, and along these rails 67 and 68, a yarn relay carriage 69 is arranged to freely run. This yarn joining carriage 69 is provided with a suction nozzle 71 as a suction tube freely rotating in a vertical direction and a suction mouse 72 freely rotating. In the drawing, a reference numeral 70 denotes a yarn joining part.

With respect to the apparatus that is configured as described above as an example, the clump cutter apparatus 1 according to the present invention may be effectively applied. This clump cutter apparatus 1 is arranged at the upstream side of the draft apparatus 56 of the spinning machine 50. As shown in FIG. 2, the clump cutter apparatus 1 may hold the end of the elastic yarn SY by switching of an electromagnetic control valve 18 and may stop when as cutting the front end of the yarn. It is the first driving means 14 configured by the actuator that operates the first slide block 4 and it is the second driving means 15 configured by the actuator that operates the second slide block 5 in the clump cutter apparatus 1. The first driving means 14 and the second driving means 15 are connected to the electro magnetic control valve 18 to be controlled by a control apparatus 19 to be operated by high-pressure air that is controlled by the electro magnetic control valve 18.

According to a specific embodiment shown in FIG. 2, the elastic yarn supplier 20 is configured so as to feed the elastic yarn SY of an elastic yarn package 24 by rotational control of a rotational roller (elastic yarn feeding roller) 23 that is attached to a rotational driving axis 22 of a yarn feeding motor 21. In this drawing, a package 24 of the elastic yarn SY is rotatably supported by a cradle arm 26 that is attached to a horizontal axis 25 to be freely rotated. This elastic yarn package 24 is configured to contact the rotational roller 23 and receive this rotation.

In apart of the elastic yarn supplier 20, at the downstream side of the rotational roller 23, an air sucker apparatus 28 is fixed. Further, the clump cutter apparatus 1 is arranged at the downstream side of this air sucker apparatus 28.

The air sucker apparatus 28 is provided with, for example, a plurality of threader members provided with threader holes having different sizes (diameters) and these plural threader members are configured in such a manner the sizes of the threader holes on the same axis are made smaller toward the downstream side, namely, the side of an elastic yarn feeding guide tube 29. Thereby, the elastic yarn SY is thread by air flowing on a center axis of the threader hole while releasing air effectively from spacing between the threader members, so that it is possible to acquire high feeding power by injecting high pressure air and without loosening the elastic yarn SY, it is possible to feed the elastic yarn SY to the draft apparatus 56 reliably.

According to the above-described application examples, by feeding the elastic yarn SY between the rotational roller 23 and the draft apparatus 56 with a predetermined ratio of expansion and contraction, the clump cutter apparatus 1 according to the present invention is particularly effective when cutting the elastic yarn SY running in the draft state.

INDUSTRIAL APPLICABILITY

According to a clump cutter apparatus of an elastic yarn described in claim 1 in the present invention, previously moving the first slide block configuring the yarn holding means to certainly hold the yarn, then, the second slide block configuring the yarn cutting means moves with time difference. Thereby, at first, the yarn can be cut after certainly holding the yarn, and in the case of using the elastic yarn that is stretched to some extent, it is possible to certainly prevent relief of the elastic yarn due to expansion and contraction thereof. In these points, it can be said that the claim 1 is very effective.

In addition, according to a clump cutter apparatus of an elastic yarn described in claim 2 in the present invention, since the yarn holding means for holding the yarn is configured by the first slide block and the second slide block, regions to hold the yarn are formed in two places, namely, between the first slid block and a laminate layer block face-to-face contacting the upstream side of this first slide block (a first place) and between the first slide block and the second slide block face-to-face contacting the downstream side of this first slide block (a second place). Further, as a distance holding the yarn is made longer, reliability of holding of the yarn is improved and the success ratio of clamp cutting is improved as much as possible. In these points, the claim 2 is very effective.

In addition, according to a clump cutter apparatus of an elastic yarn of the present invention, since the width of the upstream side path of the yarn running path in the second slide block is made narrower than that of the downstream side path thereof, it is possible to prevent the yarn from approaching a cutter blade so as to solve a problem such that before clamping of the yarn or at the same time, the yarn is cut, and this results in improvement of the success ratio of the clump cutting. In these points, the present invention is very effective.

The invention claimed is:

1. A clump cutter apparatus of an elastic yarn configured by overlapping and combining a plurality of laminate layer blocks forming a penetrating yarn running path for allowing running of a yarn to a direction of a yarn running, wherein the plural laminate layer blocks include first and second slide blocks; and said clump cutter apparatus comprising:

a yarn holding means for holding the yarn in the yarn running path due to movement of the first slide block and yarn cutting means for cutting the yarn due to movement of the second slide block after holding the yarn by the yarn holding means.

2. The clump cutter apparatus of an elastic yarn according to claim 1, wherein the yarn holding means includes the first slide block, a laminate layer block face-to-face contacting the upstream side of the first slide block, and the second slide block face-to-face contacting the downstream side of the first slide block; and the yarn cutting means include the second slide block and a cutter blade member face-to-face contacting the downstream side of the second slide block.

3. The clump cutter apparatus of an elastic yarn according to claim 1, wherein a width of the upstream side path of the yarn running path in the second slide block is made narrower than that of the downstream side path thereof.

4. The clump cutter apparatus of an elastic yarn according to claim 1, having first driving means for reciprocating the first slide block toward a first direction and second driving means capable of reciprocating the second slide block toward a second direction opposed to the first direction in the order of moving the second slide block after moving the first slide block.

5. The clump cutter apparatus of an elastic yarn according to claim 2, wherein a width of the upstream side path of the yarn running path in the second slide block is made narrower than that of the downstream side path thereof.

6. The clump cutter apparatus of an elastic yarn according to claim 2, having first driving means for reciprocating the first slide block toward a first direction and second driving means capable of reciprocating the second slide block toward a second direction opposed to the first direction in the order of moving the second slide block after moving the first slide block.

7. The clump cutter apparatus of an elastic yarn according to claim 3, having first driving means for reciprocating the first slide block toward a first direction and second driving means capable of reciprocating the second slide block toward a second direction opposed to the first direction in the order of moving the second slide block after moving the first slide block.

* * * * *